US010864731B2

(12) United States Patent
Molins Cabani et al.

(10) Patent No.: US 10,864,731 B2
(45) Date of Patent: Dec. 15, 2020

(54) MECHANICAL LOCKING MECHANISM FOR FLUID EJECTION

(71) Applicant: HEWLETT-PACKARD DEVELOPMENT COMPANY, L.P., Spring, TX (US)

(72) Inventors: Sara Molins Cabani, San Cugat del Valles (ES); Macia Sole Pons, Corvallis, OR (US); Jordi Munoz Frigola, San Cugat del Valles (ES)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/344,299

(22) PCT Filed: Feb. 10, 2017

(86) PCT No.: PCT/US2017/017485
§ 371 (c)(1),
(2) Date: Apr. 23, 2019

(87) PCT Pub. No.: WO2018/147869
PCT Pub. Date: Aug. 16, 2018

(65) Prior Publication Data
US 2019/0351678 A1 Nov. 21, 2019

(51) Int. Cl.
*B41J 2/14* (2006.01)

(52) U.S. Cl.
CPC ..... *B41J 2/1433* (2013.01)

(58) Field of Classification Search
CPC ..... B41J 2/1433; B41J 2/165; B41J 2/1752
USPC ..... 347/20, 37, 40, 44, 45
See application file for complete search history.

(56) References Cited

U.S. PATENT DOCUMENTS

| | | | |
|---|---|---|---|
| 1,858,389 | A | 5/1932 | Brown et al. |
| 6,568,793 | B2 | 5/2003 | Santhanam et al. |
| 6,722,762 | B2 | 4/2004 | Miyazawa et al. |
| 6,824,243 | B2 | 11/2004 | Yamaguchi et al. |
| 7,458,665 | B2 | 12/2008 | Batista |
| 8,651,645 | B2 | 2/2014 | Urlaub et al. |
| 8,960,874 | B1 | 2/2015 | Olsen |
| 9,211,720 | B2 | 12/2015 | Boyd et al. |
| 9,365,042 | B2 | 6/2016 | Ishizawa et al. |
| 2005/0024451 | A1 | 2/2005 | Steinmetz et al. |

FOREIGN PATENT DOCUMENTS

| | | |
|---|---|---|
| EP | 1114724 | 7/2001 |
| EP | 0816098 | 9/2002 |

OTHER PUBLICATIONS

HP Latex 3000 Printer Series—How to Work with Ink System Components < http://h20564.www2.hp.com/hpsc/doc/public/display?docId=c04167001 >.

*Primary Examiner* — An H Do
(74) *Attorney, Agent, or Firm* — Dicke Billig & Czaja PLLC

(57) ABSTRACT

A fluid ejection device is described. The fluid ejection device has a set of coding elements and a trap element. Each coding element is movable between an initial position and a coded position. The trap element is capable of trapping one or a plurality of the coding elements in the initial position when one or a plurality of other ones of the coding elements is moved from the initial position to the coded position.

20 Claims, 13 Drawing Sheets

MECHANICAL LOCKING MECHANISM FOR FLUID EJECTION

BACKGROUND

Some fluid ejection systems may employ fluid ejection devices for ejecting non-transparent fluids, e.g. black or colored ink, onto a medium, such as paper.

BRIEF DESCRIPTION OF DRAWINGS

Some examples are described with respect to the following figures.

Figure 1:
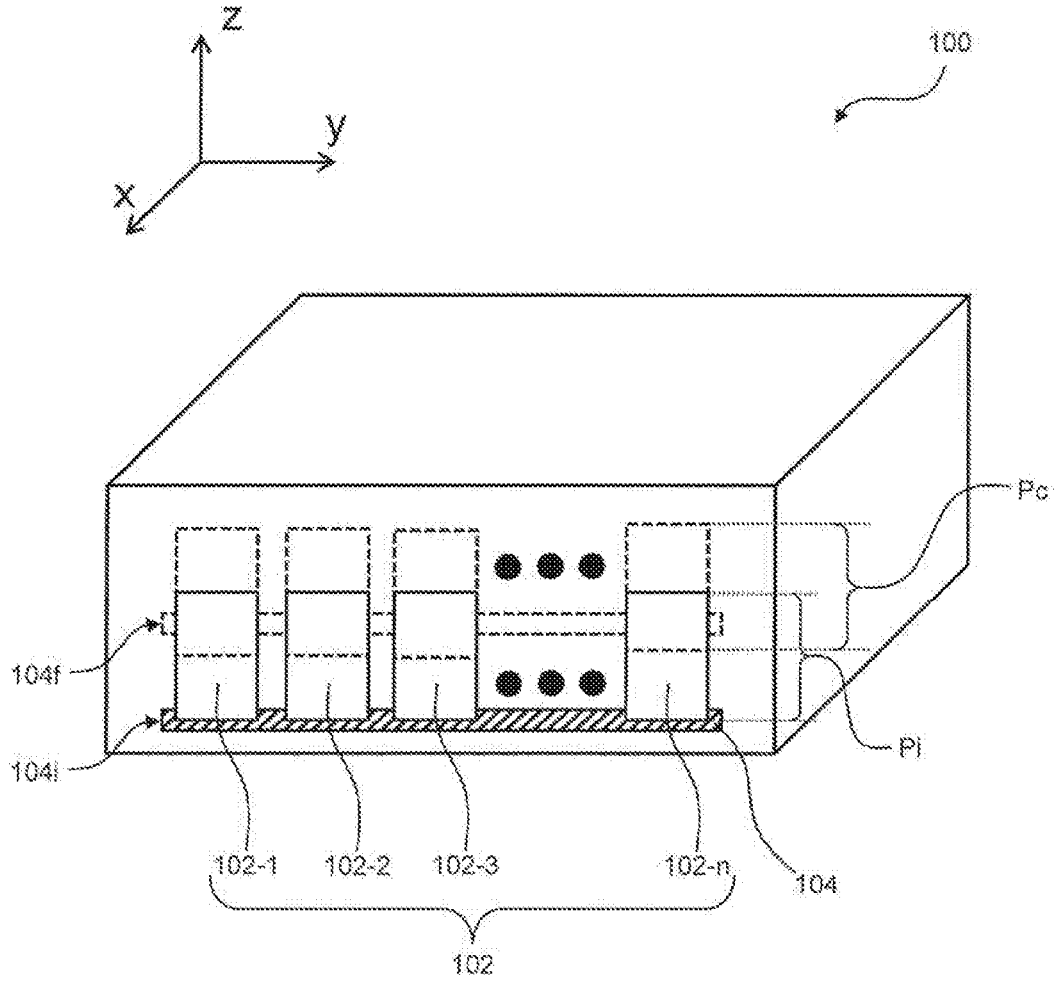
FIG. 1 shows a schematic view of an example of a fluid ejection device.

Same reference signs in the figures indicate same or similar structural features or functions.

Throughout the drawings, identical reference numbers designate similar, but not necessarily identical, elements. The figures are not necessarily to scale, and the size of some parts may be exaggerated to more clearly illustrate the example shown. Moreover the drawings provide examples and/or implementations consistent with the description; however, the description is not limited to the examples and/or implementations provided in the drawings.

DETAILED DESCRIPTION OF DRAWINGS

The fluid ejection device may comprise a print head comprising an array of nozzles. The fluid ejection device may be assigned to a specific ink color, e.g. cyan, magenta, yellow and black ("key"). Fluid ejection devices may be mounted on a carriage that moves over the printable medium while the fluid ejection devices eject ink through the nozzles. In other examples, fluid ejection devices may comprise support members coupled to a plurality of fluid ejection dies arranged along a width of the support members.

The carriage may comprise a number of carriage slots corresponding to the fluid ejection device. Inserting a fluid ejection device that has been assigned to a certain ink color into an incorrect carriage slot, i.e. a carriage slot that is assigned to a different ink color, may lead to incorrect print results and may even cause damage to the printer due to clogging of the ink. It is therefore desirable to prevent print heads from being inserted into an incorrect carriage slot or at least warn the user of such an incorrect insertion.

A fluid ejection device may comprise a fluid ejection die that may buffering and eject fluid supplied from a fluid reservoir. A fluid ejection device may include any types of devices implemented to controllably eject fluid drops. For example, a fluid ejection device may be employed with printers, three-dimensional printers, fluid analysis and titration systems. For example, a fluid ejection device may comprise a printhead module that includes at least one printhead to eject drops of ink supplied from an ink reservoir of a printer. In other examples, the fluid ejection device may comprise three dimensional print agent distributors or lab-on-a-chip devices to controllably eject fluid drops.

A print head may be referred to as generic, or universal, print head. The fluid ejection device with a generic print head may be usable for any ink color and therefore may not comprise a fixed mechanical key mechanism. A fluid ejection device with a generic print head that has been in use in a printer may be dismounted, e.g. for cleaning or repair purpose. In this case, the fluid ejection device should be remounted on the correct carriage slot in order to prevent incorrect print results and damage to the printer.

A fluid ejection device, in an example, may comprise a set of coding elements, each coding element movable between an initial position and a coded position, and a trap element to trap one or a plurality of the coding elements in the initial position when at least another one or a plurality of other ones of the coding elements is moved from the initial position to the coded position.

FIG. 1 shows a schematic view of a fluid ejection device 100 according to an example. The fluid ejection device 100 comprises a set of coding elements 102. The set 102 comprises n coding elements 102-1 to **102-*n*. Each of the coding elements 102-1 to 102-*n* is movable between an initial position Pi and a coded position Pc. FIG. 1 shows the coding elements 102-1 to 102-*n* disposed in the initial position Pi, as indicated by the solid line of the coding elements 102-1 to 102-*n*. The coded position Pc is indicated by dashed lines in FIG. 1. In some examples, the number n of the coding elements 102-1 to 102-*n* corresponds to the number of ink colors used by a specific printer. For example, if a printer uses cyan, magenta, yellow and black ink colors, the fluid ejection device comprises four coding elements 102-1 to 102-4**.

It is noted that the term initial position is not limited to the exact position of the coding elements 102-1 to **102-*n* before the coding operation. The initial position rather refers to a complementary position to the coded position, i.e. any position to which the coding elements 102-1 to 102-*n*** are movable besides the coded position. As will be described later by means of further examples, the initial position can relate to a range of positions between two boundary positions.

An operation, by which one or a plurality of the coding elements 102-1 to **102-*n* is moved from the initial position Pi to the coded position Pc, is referred to as coding operation. The coding operation causes the set of coding elements 102** to be insertable only in a carriage slot with the corresponding lockout mechanism, as will be described in detail later.

The fluid ejection device 100 further comprises a trap element 104 to trap one or a plurality of other ones of the coding elements 102-1 to **102-*n*. Trapping by the trap element 104 may refer to mechanically blocking one or a plurality of the coding elements 102-1 to 102-*n* from moving to the coded position Pc. The trap element 104 is movable between a pre-coding position 104*i* and a post-coding position 104*f*, relating to a position of the trap element before and after the coding operation, respectively. In the following, the post-coding position also is referred to as coding position. Before the coding operation, the coding elements 102-1 to 102-*n* are disposed in the initial position Pi, and the trap element 104 is disposed in the pre-coding position 104*i*. The trap element 104 is disposed so as to move to the coding position 104*f* when at the least one of the coding elements 102-1 to 102-*n*** is moved from the initial position Pi to the coded position Pc.

Figure 2:
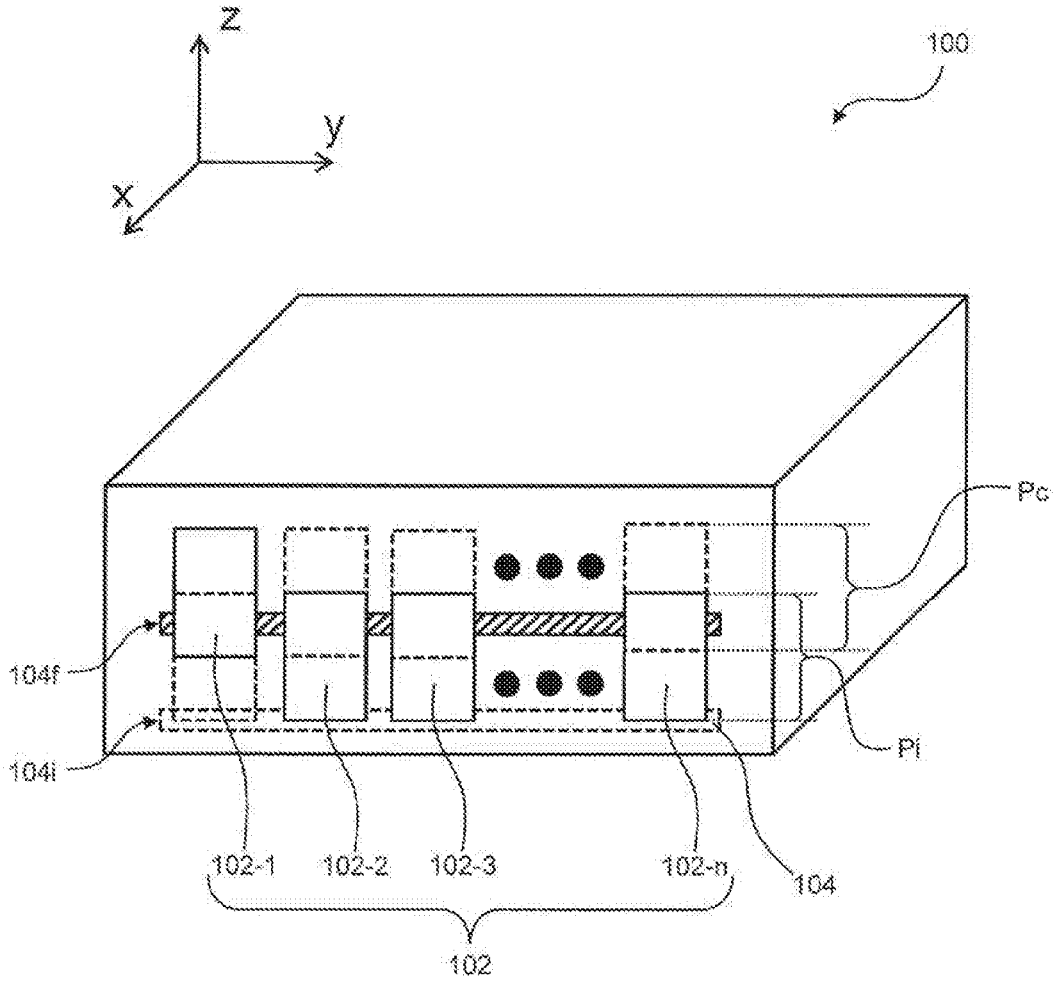
FIG. 2 shows a schematic view the fluid ejection device of FIG. 1 after being coded.

FIG. 2 schematically shows the fluid ejection device 100 after a coding operation has been performed. A coding element 102-1 has been moved from the initial position Pi to the coded position Pc during the coding operation. The rest of the coding elements 102-2 to **102-*n* remains in the initial position Pi. The trap element 104 has been moved from the pre-coding position 104*i* to the coding position 104*f*. In the coding position 104*f*, the trap element 104 blocks the remaining coding elements 102-2 to 102-*n*** from moving to the coded position Pc.

For example, the trap element 104 may be provided as a beam-shaped element extending along a first axis, also referred to as y-axis, and may have a polygonal cross section. The first axis may be perpendicular to the movement direction of the coding elements 102-1 to **102-*n* between the initial position Pi and the coded position Pc. In FIGS. 1 and 2, the trap element 104 extends along the y-axis, and the coding elements 102-1 to 102-*n* are movable along the z-axis. In the coding position 104*f*, the trap element 104 mechanically blocks any of the coding elements 102-1 to 102-*n*** from moving to the coded position Pc.

The fluid ejection device 100 allows for a mechanical coding of a set of coding elements 102, wherein the set of coding elements 102 is mechanically prevented from being further modified. By this means, the fluid ejection device 100 can only be inserted into a slot having a lockout unit corresponding to the mechanical coding of the set of coding elements 102. Hence, there is provided a mechanical lockout mechanism for a fluid ejection device.

Figure 3:
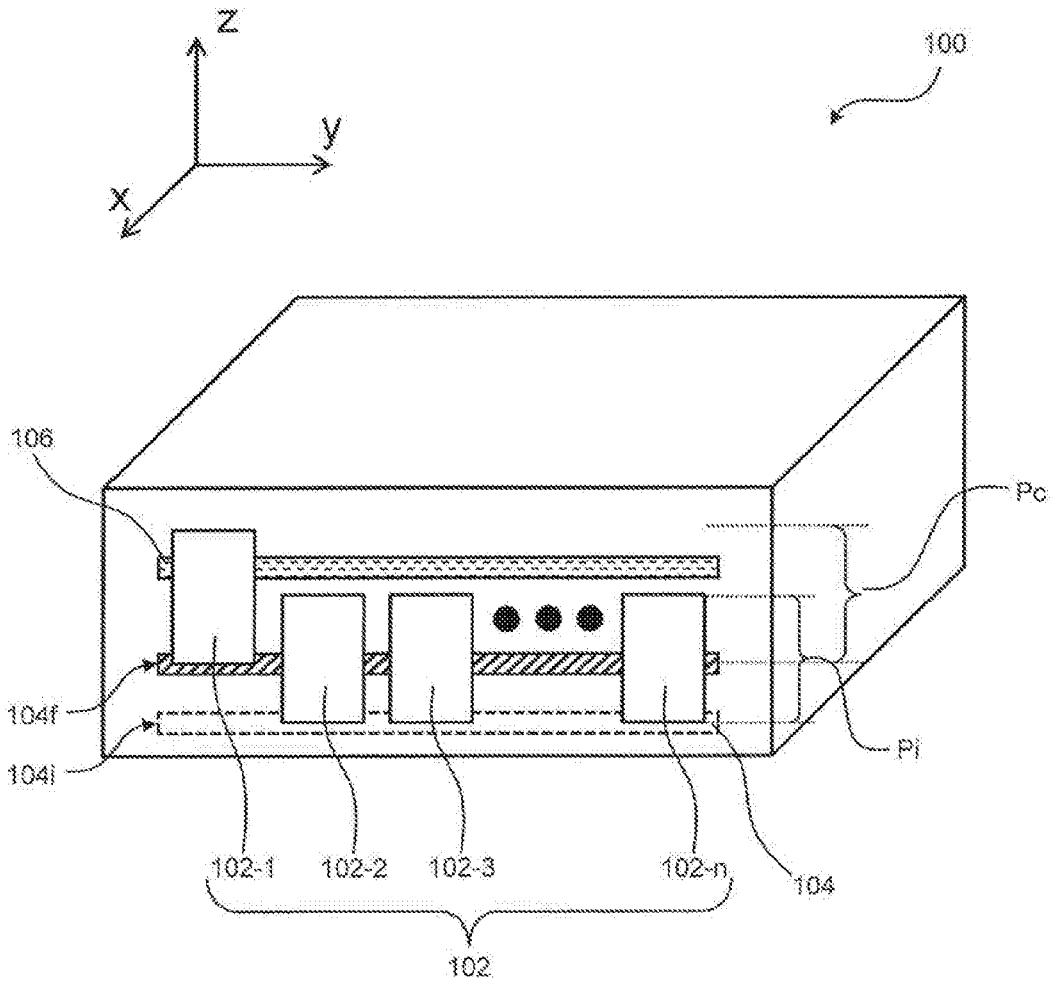
FIG. 3 shows a schematic view of a further example of a fluid ejection device.

FIG. 3 shows a schematic view of another example of the fluid ejection device 100 having a lock element 106. The lock element 106 is immovably disposed in a position over-lapping the coded position Pc of the coding elements 102-1 to **102-*n*. Any of the coding elements 102-1 to 102-*n* that is moved to the coded position Pc can engage with the lock element 106 and thereby can be held in the coded position Pc. For example, the coding element 102-1 to 102-*n* comprises a hook portion, a recess portion or a protruding portion to engage with the lock element 106**.

Figure 4:
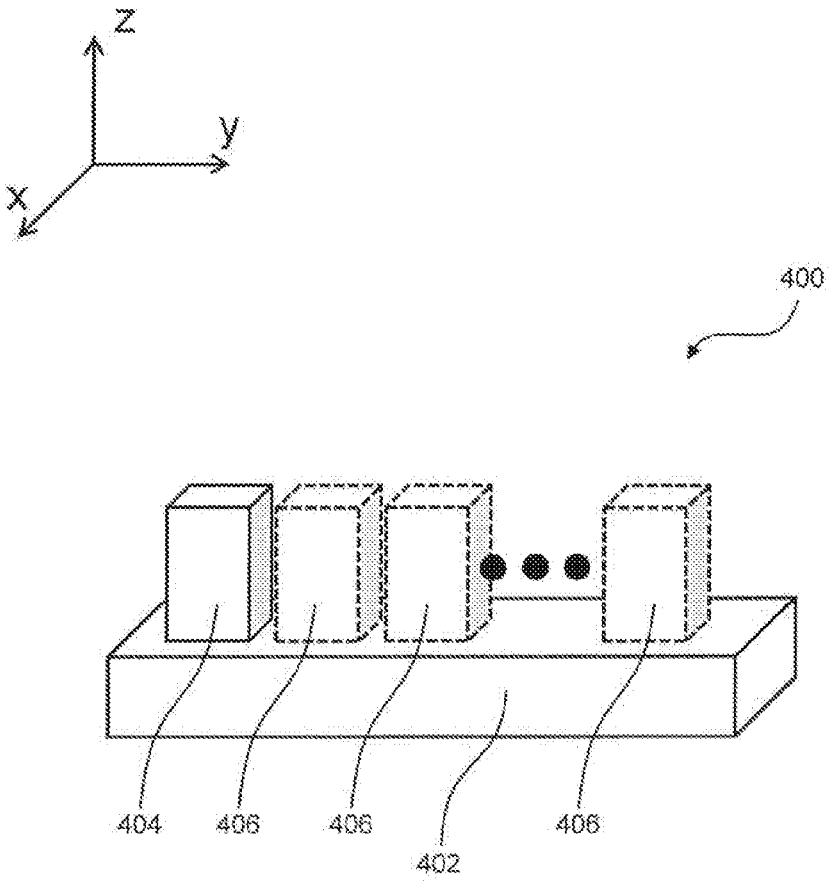
FIG. 4 shows a schematic view of an example of a lockout unit.

FIG. 4 shows a lockout unit 400 according to an example to mechanically engage with a set of coding elements, in particular the set of coding elements 102 of FIG. 1 to 3. The lockout unit 400 comprises a base member 402, on which one or a plurality of push members 404 is disposed. In some examples, the lockout unit 400 comprises one push member 404. In the example of FIG. 4, the push member 404 is positioned in the leftmost position, whereas dashed lines indicate other possible positions 406 for the push member 404.

The number of possible positions 406, including the position of the actual push member 404, may correspond to the number of the coding elements of the fluid ejection device that is to be engaged with. The push member 404 may be dimensioned so as to correspond to one of the coding elements, for example the coding elements 102-1 to **102-*n* of FIG. 1 to 3. A fluid ejection device, for example the fluid ejection device 100 of FIG. 1 to 3, may be engageable with the lockout unit 400** by being inserted from above (in the orientation of the respective figure).

Figure 5:
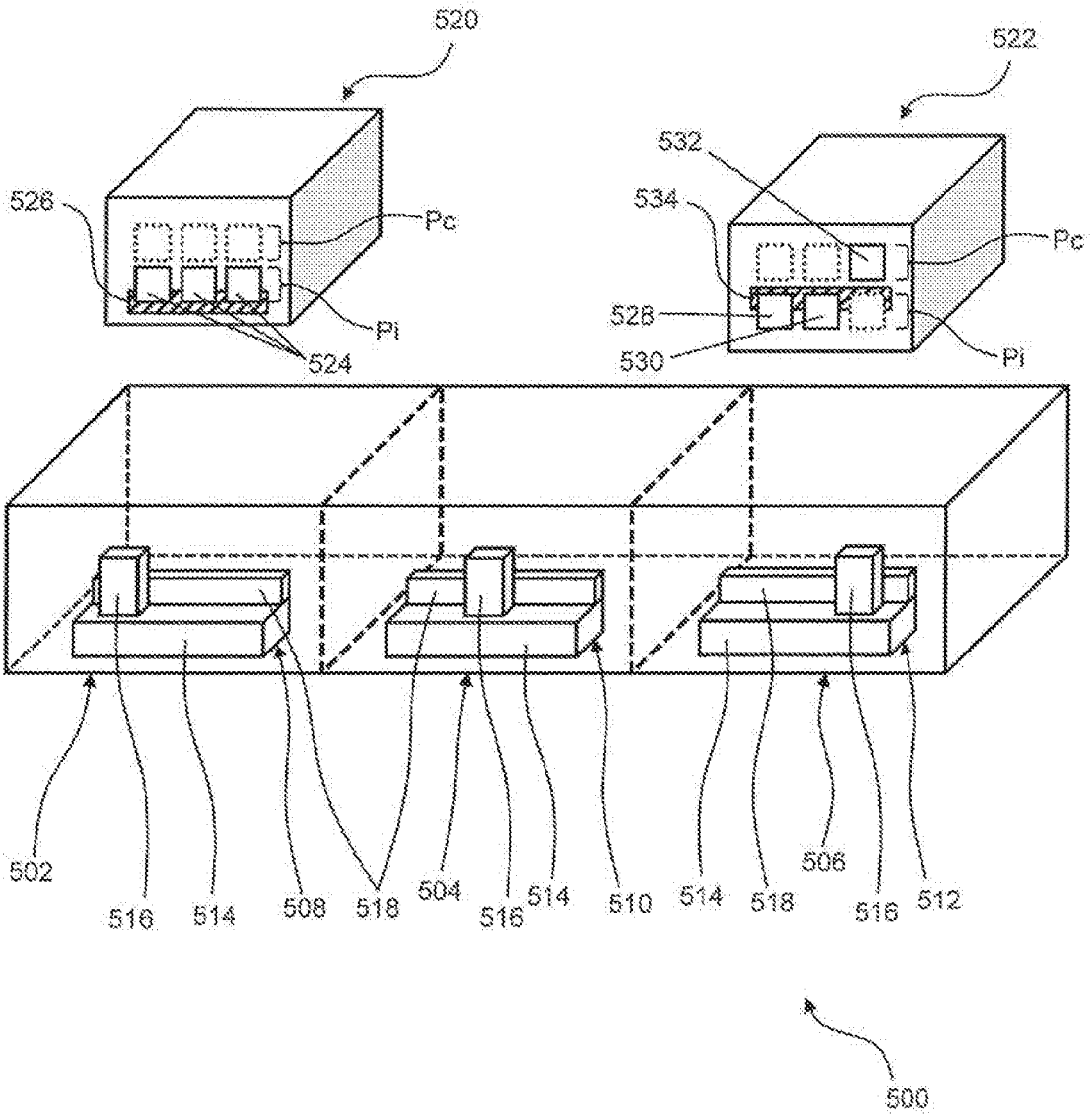
FIG. 5 shows a schematic view of examples of carriage slots with examples of fluid ejection devices.

FIG. 5 shows a carriage 500 having three carriage slots 502, 504, 506 according to an example. A first carriage slot 502 has a first lockout unit 508, a second carriage slot 504 has a second lockout unit 510, and a third carriage slot 506 has a third lockout unit 512. Each of the lockout units 508, 510, 512 has a base member 514 that is attached to the respective lockout unit 508, 510, 512. A push member 516 and a trigger member 518 protrude from a top surface of the base member 514.

The push member 516 of the first carriage slot 502 is positioned on a left site, the push member 516 of the second carriage slot 504 is positioned on a center site, and the push member of the third carriage slot 506 is positioned on a right site of the respective lockout unit 508, 510, 512. The push member 516 extends and is shaped so as to push a coding element into its coded position. In the examples of FIGS. 4 and 5, the push member 404, 516 has a cuboid shape. In other examples, the push member 516 may have any other geometric shape, e.g. of a round column, of a cone, of an angled column or a combination thereof.

The trigger member 518 extends and is shaped so as to push the trap element of a fluid ejection device from its pre-coding position to a coding position. The trigger member 518 may have the shape of an elongated beam as shown in FIG. 5. In other examples, the trigger member 518 may comprise a plurality of blocks protruding towards a fluid ejection device. The height of the trigger member 518 may be less than the height of the push member 516, wherein the height relates to an expansion in the direction towards the fluid ejection device, i.e. along the z-axis.

FIG. 5 further shows a first fluid ejection device 520 above the first carriage slot 502. The first fluid ejection device 520 comprises three coding elements 524 and a trap element 526. The first fluid ejection device 520 has not been coded yet, i.e. none of its coding elements 524 has been moved from their initial positions Pi to a coded position Pc. The coding operation can be performed by mounting the first fluid ejection device 520 on the first carriage slot 502, thereby engaging the coding elements 524 with the first lockout unit 508. During the coding operation, the push member 516 pushes the left one of the coding elements 524 from the initial position Pi to the coded position Pc. At the same time, the trigger member 518 pushes the trap element 526 from its pre-coding position to a coding position.

FIG. 5 shows a second fluid ejection device 522 above the third carriage slot 506. The second fluid ejection device 522 comprises three coding elements, consisting of a left coding element 528, a middle coding element 530 and a right coding element 532, and a trap element 534. The second fluid ejection device 522 has undergone a coding operation by being mounted on the third carriage slot 506. As a result, the coding element 532 has been moved to the coded position Pc, and to trap element 536 has been moved to the coding position by the coding operation. The left and middle coding elements 528, 530 remain in the initial position Pi. When in the coding position, the trap element 532 blocks the left and middle coding elements 528, 530 from moving to the coded position Pc. When attempting to insert the second fluid ejection device 522 into either of the first carriage slot 502 and the second carriage slot 504, the left and middle coding elements 528, 530, respectively, will strike against the push member 516 and thereby block the second fluid ejection device 522 from being fully mounted.

Figure 6:
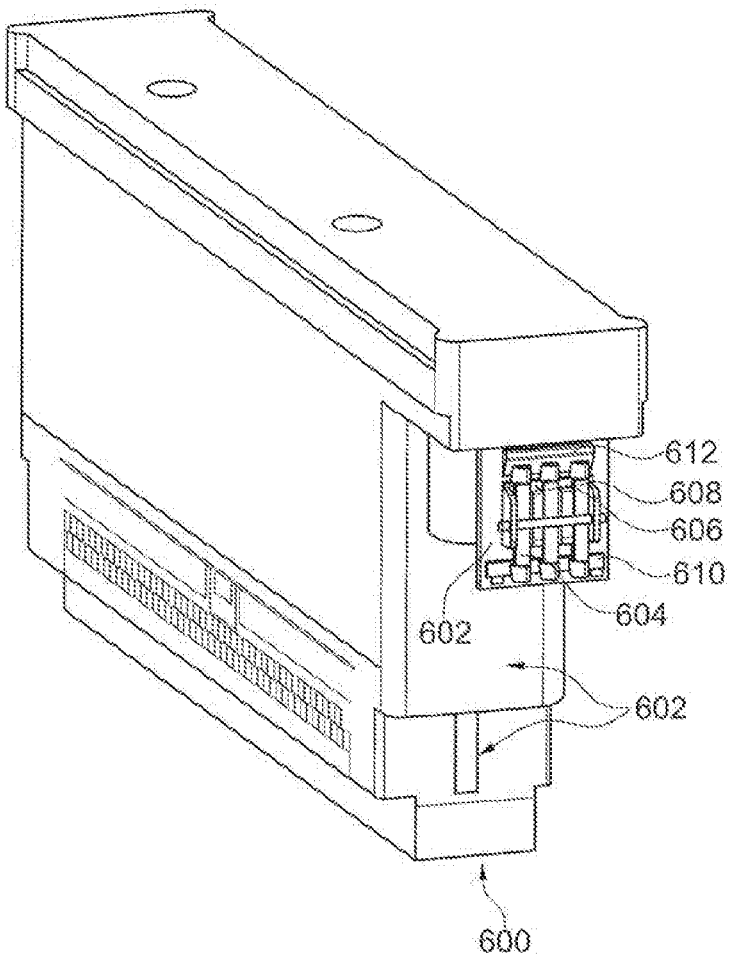
FIG. 6 shows a schematic view of a further example of a fluid ejection device.

FIG. 6 shows a further example of a fluid ejection device 600 with a generic print head. The fluid ejection device 600 has the shape of a cassette with a cascaded front wall 602, on which three coding elements 604, 606, 608 are disposed. The coding elements 604, 606, 608 have an elongated shape and are arranged parallel to one another. The fluid ejection device 600 further comprises a trap element 610 and a lock element 612. The trap element 610 has the shape of a beam extending perpendicular to the coding elements 604, 606, 608. The coding elements 604, 606, 608 can engage with the lock element 612, if and when they are moved to their coded position.

Figure 7:
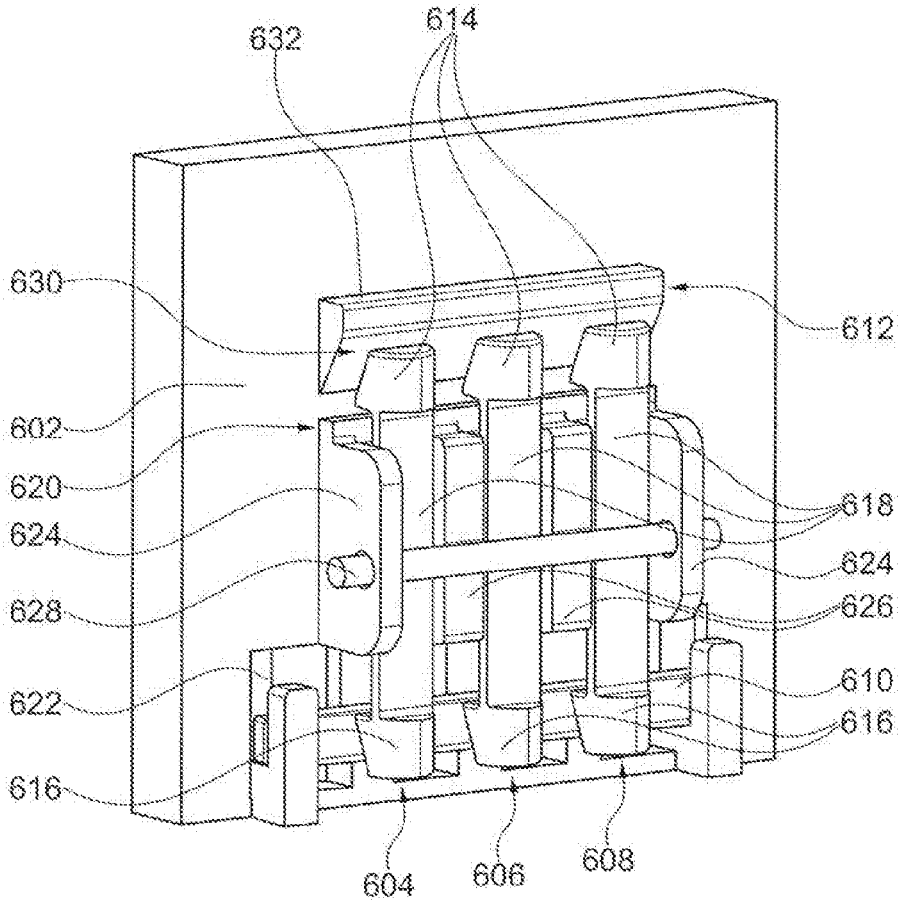
FIG. 7 shows a partial view of the fluid ejection device of FIG. 6.

FIG. 7 shows a partial view of the fluid ejection device 600 of FIG. 6. Each of the coding elements 604 606, 608 comprises a hook portion 614 and a support portion 616 that correspond to end portions of the coding elements 604, 606, 608. Each hook portion 614 and the corresponding support portion 616 are connected by a connection portion 618. Each of the hook portions 614 and the support portion 616 has the shape of a cylinder on one side and the shape of a ramp on the opposite side. The ramps of the hook portions 614 and the support portion 616 grow along the elongation axis of each of the coding elements 604, 606, 608 towards the respective center. The connection portions 618 comprise an elastic material such that the coding elements 604, 606, 608 are bendable between the respective hook portion 614 and the support portion 616. A frame 620 that is attached to the front wall 602 holds the coding elements 604, 606, 608. The frame 620 has side walls 624, spacers 626 and a pin 628 to house parts of the coding elements 604, 606, 608 in between.

The trap element 610 is movably disposed within a groove 622 that is formed into the front wall 602. The trap element is 610 is movable between a pre-coding position that is the lowermost position within the group 622 and a coding position that is any position above the support portion 616 of one or a plurality of of the coding elements 604, 606, 608. The trap element 610 has a sloped surface that is tilted with respect to the front wall 602. In their initial position as shown in FIGS. 6 and 7, the support portions 616 of the coding elements 604, 606, 608 abut against the sloped surface of the trap element 610.

The lock element 612 comprises a lock ramp 630 on which the hook portion 614 of the coding elements 604, 606, 608 can glide. The lock element 612 further comprises a strike surface 632 on which the coding elements 604, 606, 608 can rest when brought into a coded position.

Figure 8:
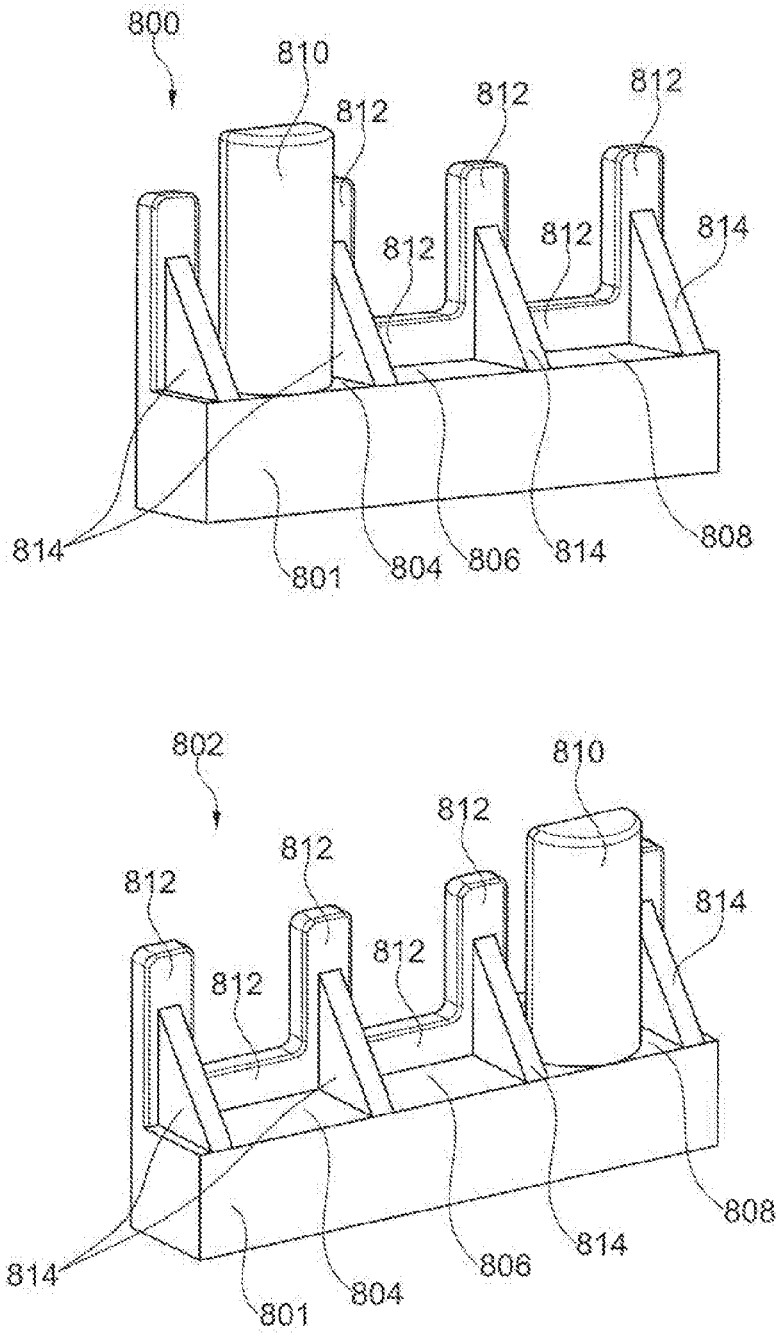
FIG. 8 shows schematic views of further examples of lockout units.

FIG. 8 shows a first lockout unit 800 and a second lockout unit 802 according to an example. Each of the first and second lockout units 800, 802 comprises a base member 801 on which three compartments 804, 806, 808 are formed that correspond to the three coding elements 604, 606, 608 of the fluid ejection device 600 of FIGS. 6 and 7. A push member 810 is disposed in one of the compartments 804, 806, 808. The push member 810 has the shape of a column with a semicircular cross section. The push member 810 of the first lockout unit 800 is positioned in the left compartment 804 (in the orientation of FIG. 8), whereas push member 810 of the second lockout unit 802 is positioned in the right compartment 808.

The first and second lockout units 800, 802 further comprise a trigger member 812 protruding upwards from the respective base member 801. The trigger member 812 has the shape of a finger-shaped wall, i.e. a wall with two alternate heights. The trigger member 812 is further supported by a plurality of struts 814 that are formed on top of the base member 801. The struts 814 further divide the top surface of the base member 801 into the compartments 804, 806, 808.

Figure 9:
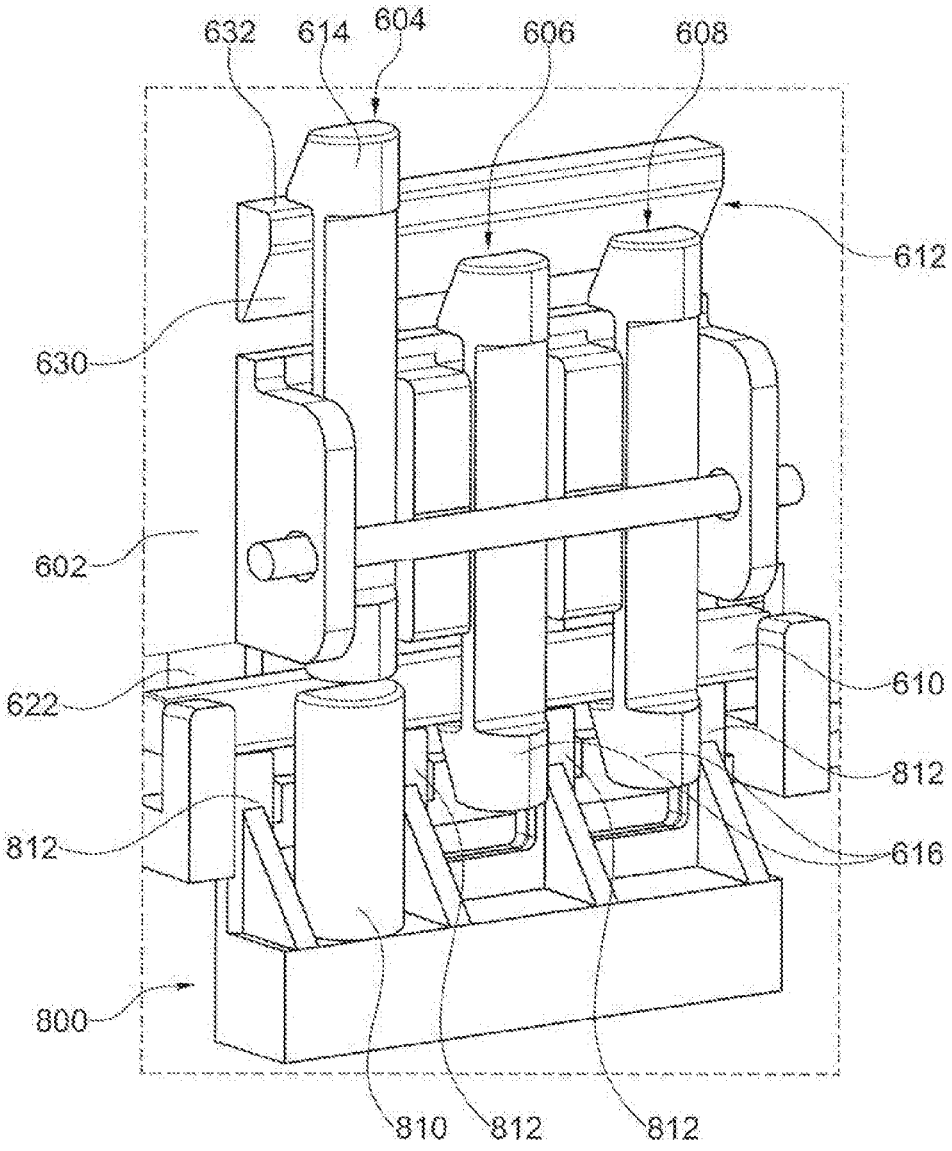
FIG. 9 illustrates the fluid ejection device of FIG. 6 engaging with one of the lockout units of FIG. 8.

FIG. 9 shows a partial view of the fluid ejection device 600 of FIGS. 6 and 7 being engaged with the first lockout unit 800 of FIG. 8, thereby undergoing a coding operation. The push member 810 has pushed the left coding element 604 into its coded position. The hook portion 614 of the coding element 604 has moved along the lock ramp 630 of the lock element 612 and rests on the strike surface 632 thereof. The trap element 610 has been pushed upwards by the trigger member 812 and has been moved to the coding position above the support portions 616 of the coding elements 606, 608.

Figure 10:
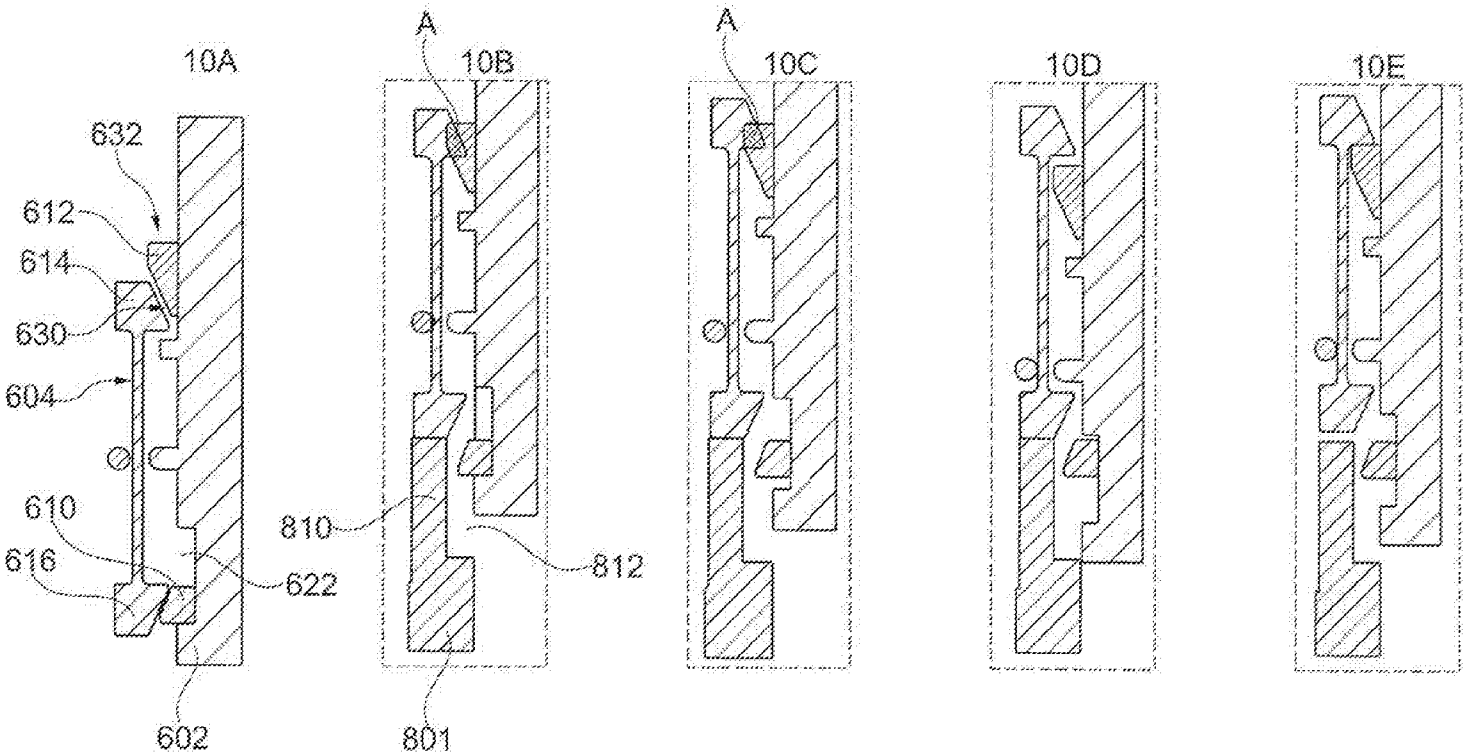
FIG. 10 shows subsequent cross-sectional views of one of the coding elements of FIG. 6 and one of the lockout units of FIG. 8.
Figure 11:
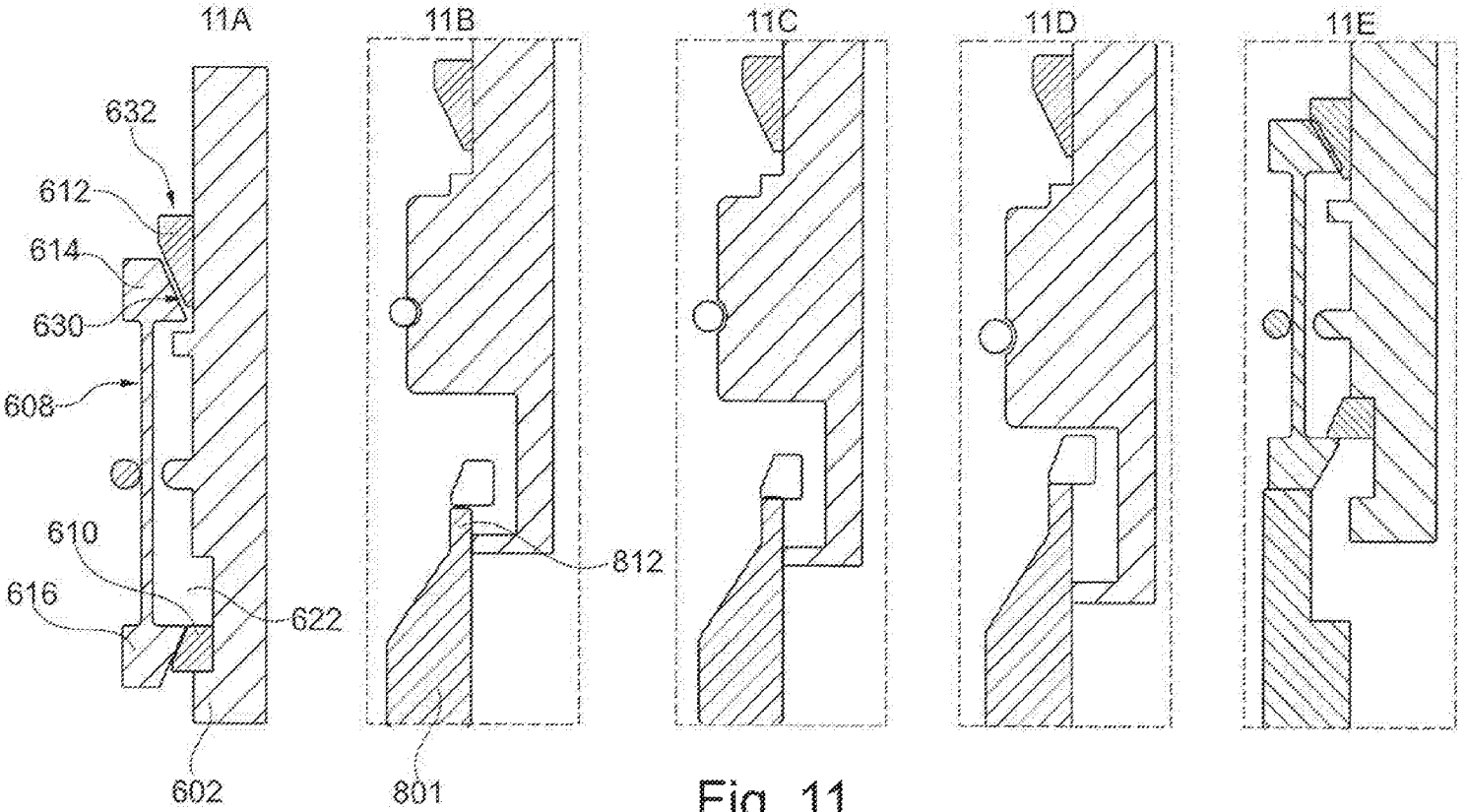
FIG. 11 shows subsequent cross-sectional views of one another of the coding elements of FIG. 6 and one of the lockout units of FIG. 8.

FIGS. 10 and 11 show subsequent cross-sectional views 10A-10E and 11A-11E of the coding element 604 and the coding element 608, respectively, during the coding operation of FIG. 9. Views 10A and 11A show the coding elements 604, 608 before the coding operation, i.e. before being engaged with a lockout unit, when the trap element 610 is in the pre-coding position. In views 10A and 11A, the respective coding element 604, 608 is clamped between the trap element 610 and the lock element 612.

In view 10B, the push member 810 pushes the coding element 604 upwards. The hook portion 614 of the coding elements 604 glides along the lock ramp 630 of the lock element 612. While gliding, the hook portion 614 experiences resistance due to fiction at the surface of the lock ramp 630 and due to deformation of the connection portion 618. The resistance is indicated by a hatched area A in which the hook portion 614 and the lock element 612 intersect. Further in view 10B, the trigger member 812 abuts against the trap element 610 from below.

In view 10C, the hook portion 614 has almost overcome the lock element 612. Meanwhile, the trigger member 812 lifts the trap element 610.

In view 10D, the hook portion 614 has been pushed beyond the lock element 612. The position of the push member 810 relative to the fluid ejection device 600 is limited by the trap element 610 abutting against an upper wall of the groove 622.

In view 10E, the fluid ejection device 600 has been released. The coding element 604 is no more supported by the push member 810. The hook portion 614 rests on the strike surface 632 of the lock element 612. Thus, lock element 612 engages with the coding elements 604, thereby holding it in its coded position.

The view 11A shows a pre-coding state as mentioned above. In view 11B, the trap element 610 is lifted by the trigger member 812. The sloped surface of the support portion 616 rests on the sloped surface of the trap element 610. This causes the coding element 604 to be lifted by the trigger member 812 as well.

In view 11C, the hook portion 614 of the coding element 608 abuts against the lock element 612. As the upwards pushing force is exerted on the trap element 610, the pushing force is transferred via the sloped surfaces of the trap element 610 and the support portion 616. The hook portion 614 glides along the lock ramp 632, because the inclination of the sloped surface of the trap element 610 with respect to the front wall 602 is greater than the inclination of the lock ramp 632. At the same time, the friction resistance between the lock element 612 and the hook portion 614 increases due to an increase of the contact area, and the deformation resistance against bending the coding element 608 increases as well. Once these resistance forces overweigh the upwards pushing force, the coding element 608 stops advancing upwards.

As the trap element 610 is being pushed further upwards, the connection portion 618 bends and causes the support portion 616 snap below the trap element. In view 11D, the trap element 610 thereby has been pushed past the support portion 616 of the coding element 608 by the trigger element 812. The trap element 610 is in the coding position that is above the support portion 616 in this example. Accordingly, the pre-coding position and the coding position of the trap element 610 are on opposite sides of the support portion 616. The trap element 610 has been moved between the support portion 616 and the hook portion 614.

View 11E illustrates a situation in which the coding element 608 is being pushed by the push member 814. The support portion 616 receives the lifting force from the push member 814. The support portion 616 strikes against the trap element 610, causing it to abut against the upper wall of the groove 622. The trap element 610 cannot advance further, thereby blocking the coding elements 608 from moving upwards. As a result, the coding element 608 is trapped by the trap element 610 in the initial position.

Figure 12:
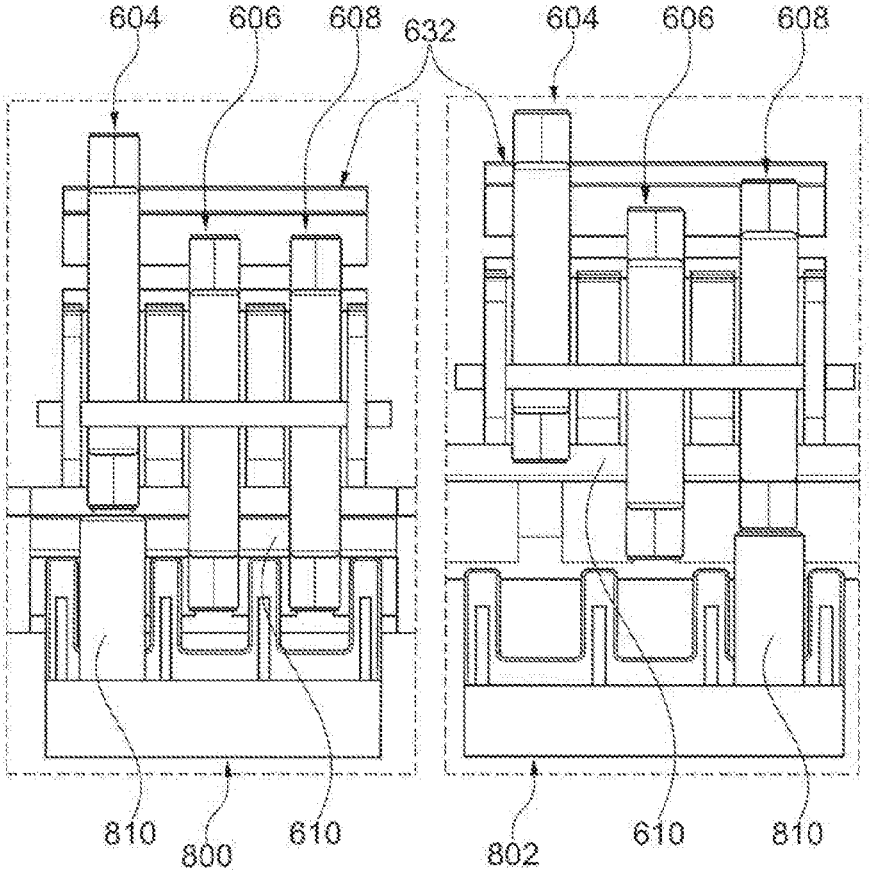
FIG. 12 shows schematic front views of the fluid ejection device of FIG. 9 and the lockout units of FIG. 8.

FIG. 12 illustrates the coding elements 604, 606, 608 that have been coded according to FIG. 7 engaging with the first lockout unit 800 and the second lockout unit 802. A fluid ejection device having the coding elements 604, 606, 608 can be mounted on and dismounted from a carriage slot having the first lockout unit 800 without being mechanically blocked, as shown on the left hand side of FIG. 12. On the contrary, the push member 810 of the second lockout unit 802 strikes against the third coding element 608 which cannot be moved upwards because of the trap element 610 being in the coding position, as shown on the right hand side of FIG. 12. As a result, inserting the fluid ejection device having the coding elements 604, 606, 608 into a carriage slot having the second lockout unit 802 is mechanically blocked.

Any of the above described examples of fluid ejection devices and lockout units may be part of a printer or mountable on a printer. Accordingly, a printer may comprise a fluid ejection device and a first slot and a second slot. The fluid ejection device may have a set of coding elements. Each coding element may be movable between an initial position and a coded position. The first slot and the second slot may each receive the fluid ejection device. The first slot and the second slot may have a first lockout unit and a second lockout unit, respectively. Each lockout unit may mechanically engage with the set of coding elements. The first lockout unit may have a pushing member to push one of the coding elements into the coded position. The second lockout unit may have another pushing member to push another one of the coding elements into the coded position. The fluid ejection device may comprise a trap element to trap one or a plurality of other coding elements in the initial position when the one of the coding elements is moved from the initial position to the coded position.

Figure 13:
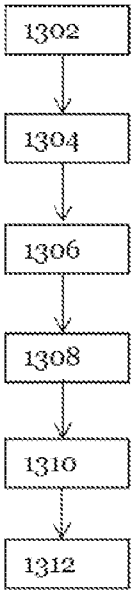
FIG. 13 shows a flow diagram of a method according to an example.

FIG. 13 shows a flow diagram of an example of a method 1300 for mechanically coding a fluid ejection device to a slot of a printer may comprise providing 1302 the fluid ejection device with a set of coding elements, each coding element movable between an initial position and a coded position; providing 1304 the fluid ejection device with a trap element to trap any of the coding elements in the initial position; providing 1306 the slot with a push member to push one of the coding elements into the coded position; mounting 1308 the fluid ejection device on the slot; pushing 1310, by the push member, a first one of the coding element into the coded position; and holding 1312, by the trap element, one or a plurality of a second coding elements in the initial position. In particular, such a method may be applicable to any of the above described examples of fluid ejection devices, lockout units or a printer.

The invention claimed is:

1. A fluid ejection device, comprising:

a set of coding elements, each coding element movable between an initial position and a coded position, a trap element to trap one or a plurality of the coding elements in the initial position when another one or a plurality of other ones of the coding elements is moved from the initial position to the coded position, and a lock element to lock the another one or the plurality of other ones of the coding elements in the coded position when moved from the initial position to the coded position.

2. The fluid ejection device of claim 1, wherein the trap element is to move from a pre-coding position to a coding position when the another one or the plurality of other ones of the coding elements is moved from the initial position to the coded position; and in the coding position, the trap element is to block the one or the plurality of the coding elements from moving to the coded position.

3. The fluid ejection device of claim 2, wherein a movement direction of the trap element from the pre-coding position to the coding position is parallel to movement direction of the another one or the plurality of other ones of the coding elements.

4. The fluid ejection device of claim 2, wherein each of the coding elements comprises a support portion to block the trap element from moving from the coding position to the pre-coding position; and the pre-coding position and the coding position of the trap element are on opposite sides with respect to the support portion.

5. The fluid ejection device of claim 2, wherein the coding elements are between the lock element and the trap element when the coding elements are in the initial position and the trap element is in the pre-coding position.

6. The fluid ejection device of claim 1, wherein the trap element is movably disposed within a groove formed in or on a surface of the fluid ejection device.

7. The fluid ejection device of claim 1, further comprising the lock element to engage with the another one or the plurality of other ones of the coding elements when brought into the coded position.

8. The fluid ejection device of claim 7, wherein the lock element comprises a lock ramp along which the another one or the plurality of other ones of the coding elements is to glide in order to move from the initial position to the coded position; and the lock ramp is arranged to increase one or a plurality of friction resistance and deformation resistance against the movement of any coding element from the initial position to the coded position.

9. The fluid ejection device of claim 8, wherein the trap element comprises a support ramp opposite to the lock ramp; and the slope of the support ramp is greater than the slope of the lock ramp.

10. The fluid ejection device of claim 1, wherein the coding elements comprise an elastic material, in particular rubber or polymer.

11. The fluid ejection device of claim 1, wherein each of the coding elements comprises a hook portion to engage the lock element when moved from the initial position to the coded position.

12. The fluid ejection device of claim 1, wherein each of the coding elements is to deform when moved from the initial position to the coded position.

13. A printer, comprising:

a fluid ejection device having a set of coding elements, each coding element being movable between an initial position and a coded position; and a first slot and a second slot, each to receive the fluid ejection device, the first slot having a first lockout unit and the second slot having a second lockout unit, each lockout unit to mechanically engage with the set of coding elements, wherein the first lockout unit has a pushing member to push one of the coding elements into the coded position and the second lockout unit has another pushing member to push another one of the coding elements into the coded position;

wherein the fluid ejection device comprises a trap element to trap one or a plurality of other coding elements in the initial position when the one of the coding elements is moved from the initial position to the coded position, and a lock element to lock the one of the coding elements in the coded position when moved from the initial position to the coded position.

14. The printer of claim 13, wherein each of the first lockout unit and the second lockout unit further comprises a trigger member to move the trap member to a coding position, in which the trap element is to block the one or the plurality of other coding elements from moving to the coded position.

15. The printer of claim 13, further comprising a third slot having a third lockout unit having a yet another pushing member to push one yet another coding element into the coded position.

16. The printer of claim 13, further comprising a carriage including the first slot and the second slot to receive the fluid ejection device and one or a plurality of a further fluid ejection device that is similar or identical to the fluid ejection device.

17. The printer of claim 13, wherein the lock element comprises a lock ramp along which the one of the coding elements is to glide to move from the initial position to the coded position.

18. The printer of claim 17, wherein the lock ramp is to increase resistance against movement of any coding element from the initial position to the coded position.

19. A method for mechanically coding a fluid ejection device to a slot of a printer, comprising:

providing the fluid ejection device with a set of coding elements, each coding element movable between an initial position and a coded position;

providing the fluid ejection device with a trap element to trap any of the coding elements in the initial position;

providing the fluid ejection device with a lock element to lock any of the coding elements in the coded position;

providing the slot with a push member to push one of the coding elements into the coded position;

mounting the fluid ejection device on the slot;

pushing, by the push member, a first one of the coding elements into the coded position;

locking, by the lock element, the first one of the coding elements in the coded position; and holding, by the trap element, one or a plurality of second coding elements in the initial position.

20. The method of claim 19, wherein pushing the first one of the coding elements into the coded position comprises gliding a hook portion of the first one of the coding elements along a lock ramp of the lock element; and locking the first one of the coding elements in the coded position comprises resting the hook portion of the first one of the coding elements on a strike surface of the lock element.

* * * * *